US005472356A

United States Patent [19]

Bricaud

[11] Patent Number: 5,472,356

[45] Date of Patent: Dec. 5, 1995

[54] NETWORK CONNECTOR

[75] Inventor: Herve Bricaud, Dole, France

[73] Assignee: ITT Corporation, New York, N.Y.

[21] Appl. No.: 321,945

[22] Filed: Oct. 12, 1994

Related U.S. Application Data

[63] Continuation-in-part of Ser. No. 243,337, May 16, 1994, abandoned, which is a continuation of Ser. No. 26,727, Mar. 5, 1993, abandoned.

[30] Foreign Application Priority Data

Mar. 9, 1992 [FR] France ..... 92 02780

[51] Int. Cl.[6] ..... H01R 13/66

[52] U.S. Cl. ..... 439/620; 333/12; 333/181; 361/56; 361/111

[58] Field of Search ..... 439/620, 95, 108; 361/56, 111; 333/12, 181, 260

[56] References Cited

U.S. PATENT DOCUMENTS

| | | | |
|---|---|---|---|
| 3,218,600 | 11/1965 | Mouttet | 439/352 |
| 3,944,317 | 3/1976 | Oberdiear | 439/610 |
| 4,413,871 | 11/1983 | Swengel, Jr. | 439/92 |
| 4,583,809 | 4/1986 | Werth et al. | 439/610 |
| 4,838,813 | 6/1989 | Pauza et al. | 439/620 |

FOREIGN PATENT DOCUMENTS

| | | | |
|---|---|---|---|
| 1130882 | 6/1962 | Germany | 439/607 |

*Primary Examiner*—Gary F. Paumen
*Attorney, Agent, or Firm*—Freilich Hornbaker Rosen

[57] ABSTRACT

The invention provides a telephone network connector (10, FIG. 8) with a rear portion (47) that holds a cartridge (56) which enables connections directly to ground and through a circuit component to ground. The cartridge lies within an electrically grounded metal shell (32), that, in turn, lies within a molded dielectric container (48). The cartridge has a grounded contact element (74, FIG. 2) which has threaded part (78) extending through a threaded hole (80) in the grounded shell. The cartridge also has a nongrounded contact element (76) which projects through a bushing part (92) of the dielectric container, which isolates the nongrounded contact from the walls of a hole (91) in the metal shell. The molded dielectric container forms a front connect tube (51, FIG. 8) and a pair of side tubes (52, 53).

8 Claims, 5 Drawing Sheets

NETWORK CONNECTOR

This is a continuation-in-part of U.S. Ser. No. 08/243,337 filed May 16, 1994, now abandoned, which is a continuation of U.S. Ser. No. 08/026,727 filed Mar. 5, 1993, now abandoned.

BACKGROUND OF THE INVENTION

Transmission lines, such as those of telephone or data networks, require connectors along the line where different stations are connected to the line. Many connectors require a component such as a capacitor to dissipate any high voltage pulse (e.g. from lightning) to ground, or no component at all (direct connection to ground). Some stations require other components such as an amplifier, or a line termination circuit at the last station along the line. The connector at each of such stations must be rugged, since a break in the transmission line at any station can interrupt the entire network, and are preferably of a standard mechanical construction.

SUMMARY OF THE INVENTION

In accordance with one embodiment of the present invention, a rugged and versatile connector is provided for use in a network. The connector includes a dielectric container with a rear wall, and a metal shell that lies closely within the container and that has a rear wall with ground and nonground holes. A cartridge with a circuit component-holding region lies within the shell. The dielectric container has a bushing part that projects forwardly through the nonground hole in the shell. While a ground contact element of the cartridge is engaged with the walls of the shell ground hole, a nonground contact element of the cartridge extends through the bushing.

The novel features of the invention are set forth with particularity in the appended claims. The invention will be best understood from the following description when read in conjunction with the accompanying drawings.

DESCRIPTION OF THE PREFERRED EMBODIMENT

Figure 7:
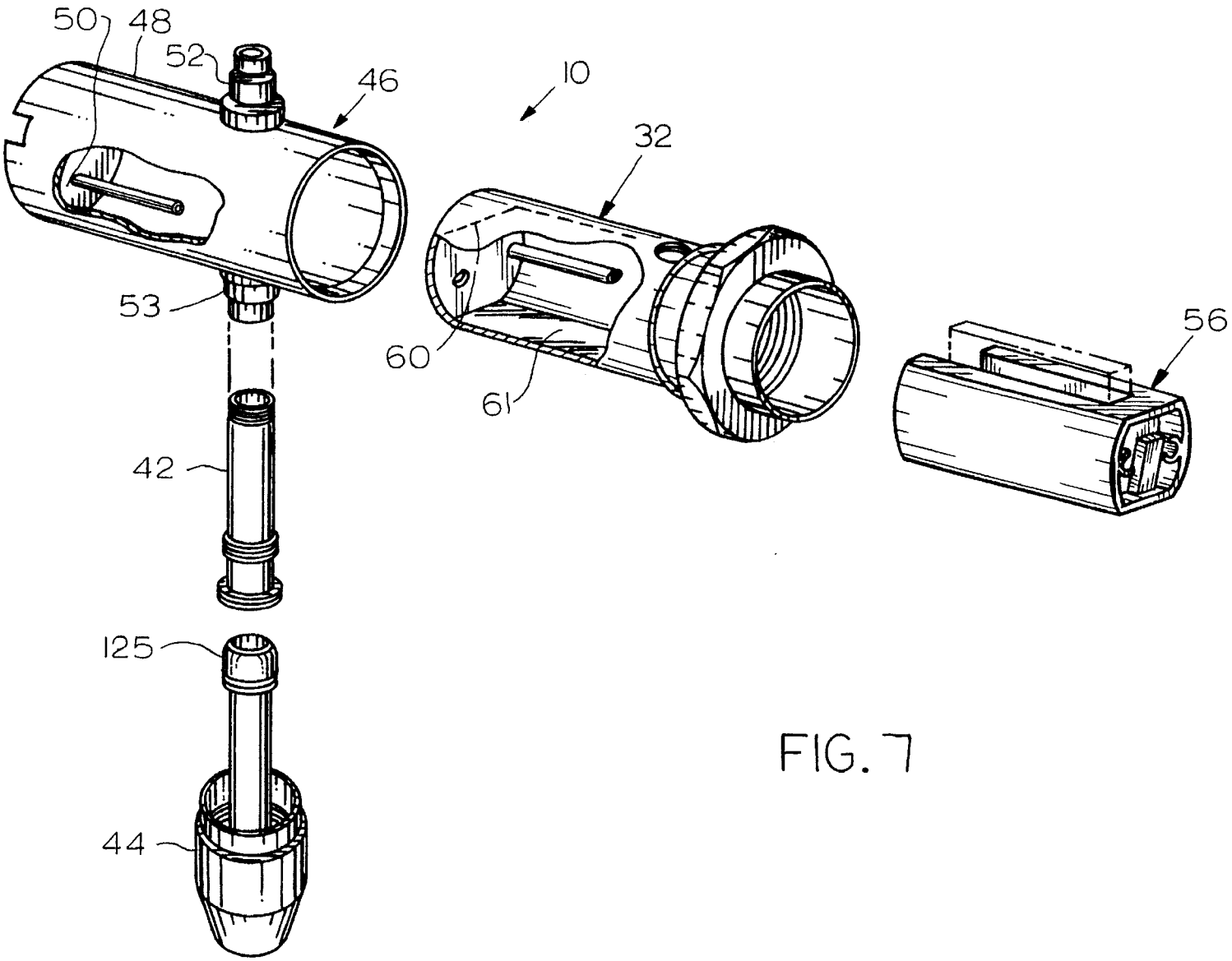
FIG. 7 is an exploded view of a portion of the connector of FIG. 1.

FIG. 7 shows an electrical connector 10 which includes a dielectric container 46 having a cylindrical side wall 48 and having an end wall 50. A metal shell 32 lies closely within the container. An insert or cartridge 56 lies closely within the shell.

Figure 8:
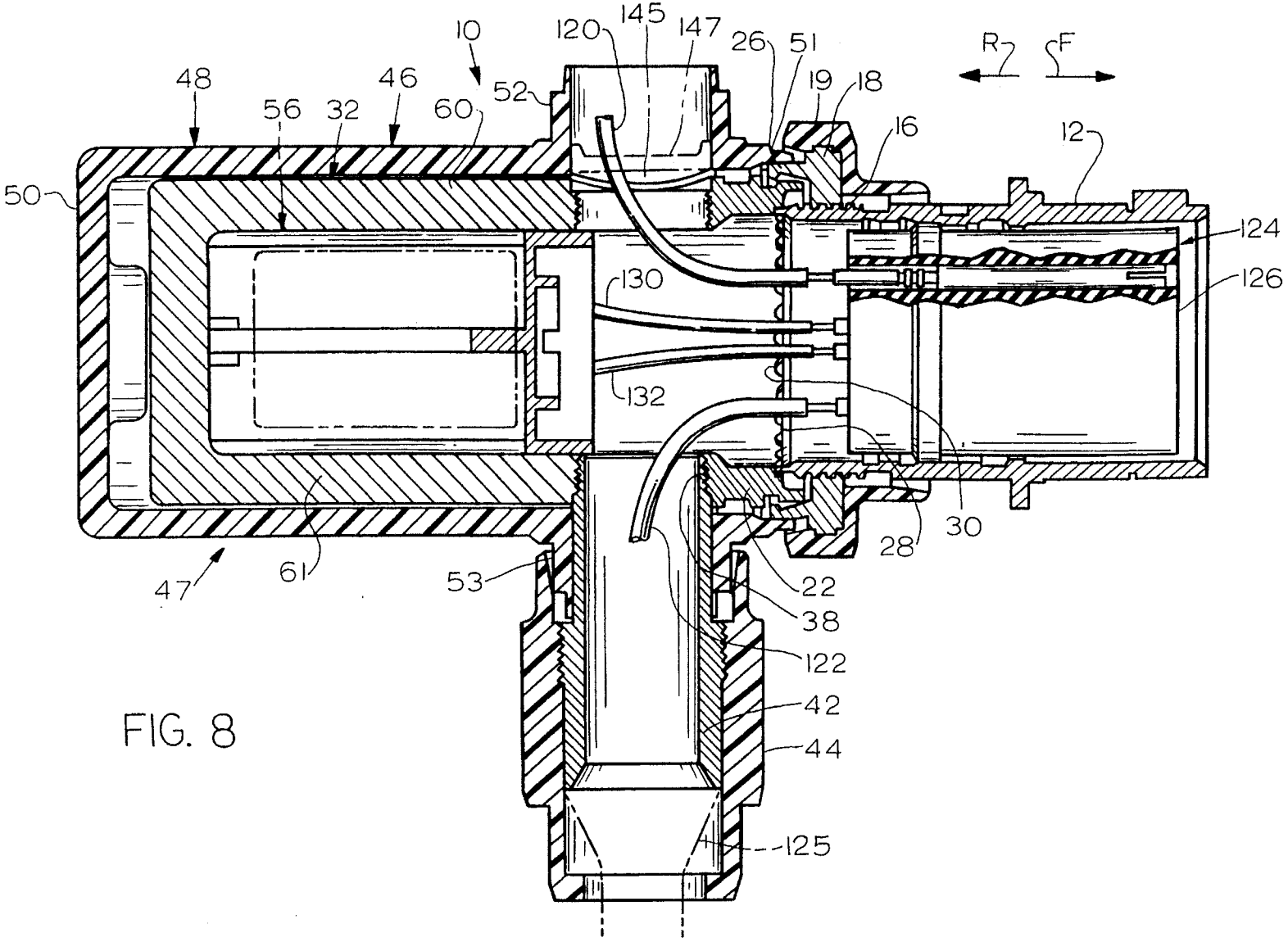
FIG. 8 is a view largely similar to that of FIG. 1 but showing additional parts.

As shown in FIG. 8, the connector is used in a telephone and/or data network, wherein the connector 10 and many other similar connectors are connected largely in series in the network. Arrows F and R indicate forward and rearward directions. FIG. 8 shows a pair of network cables 120, 122 that connect to other stations of the network. The connector 10 has an interface coupling 124 with a forward end 126 that connects to a telephone, modem, or other station signal generator/receiver. Four cables or wires 120, 122, 130 and 132 connect to the interface coupling, with two wires 130, 132 leading to the insert 56.

Figure 2:
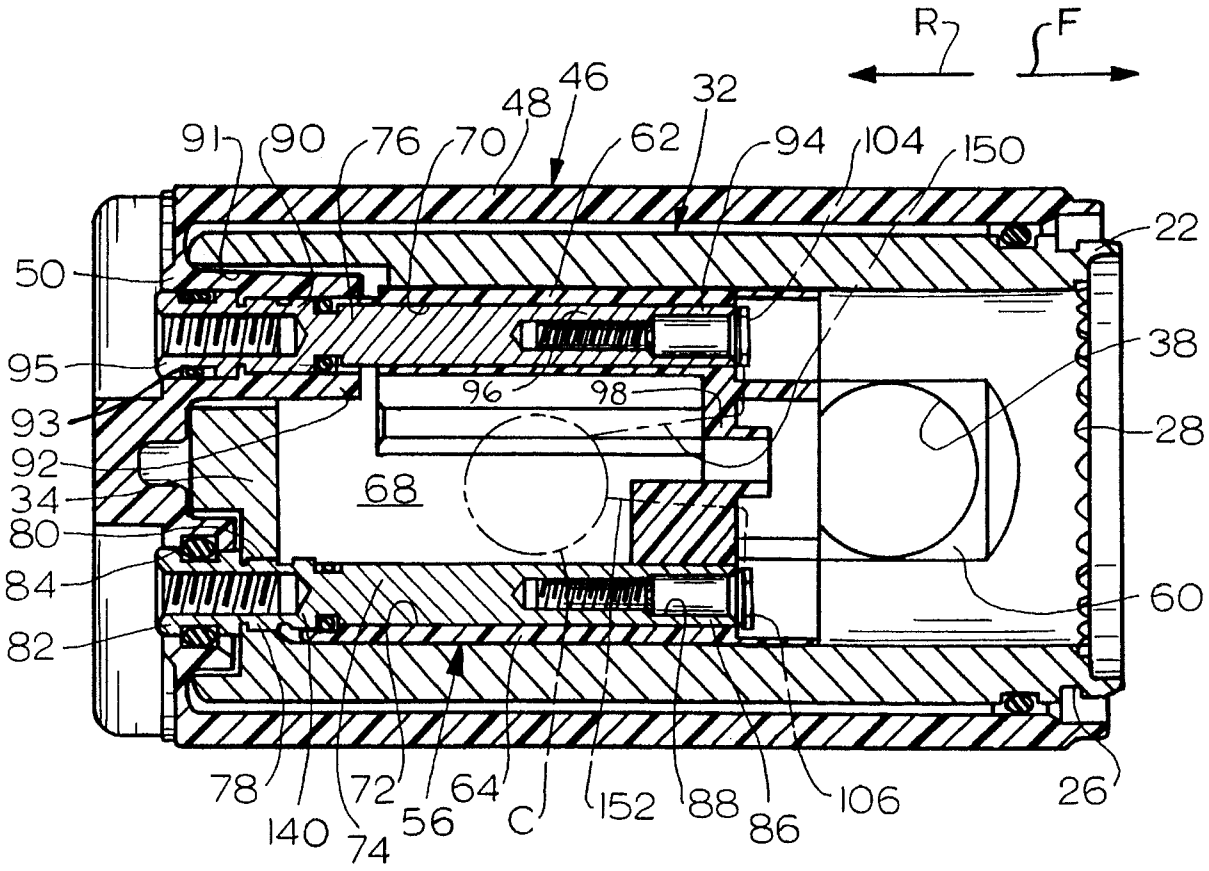
FIG. 2 is a partial sectional side view taken on line 2—2 of FIG. 1, and showing the cartridge.

As shown in FIG. 2, the insert 56 includes a dielectric cartridge frame 62 that forms a component-holding region 68. For some connectors in the network, a capacitor C lies in the region 68 to connect to ground any large voltage pulses such as from lightning. The metal shell 32 is connected to ground. For some connectors, an amplifier circuit may lie in or connect to the cartridge. Some connectors may hold or connect to a locating circuit which enables quick location of the connector along the network from a central station. Some connectors do not hold any circuit component in the region 68.

The cartridge 56 includes two contact elements, including a grounded contact element 74 and a nongrounded element 76, for direct or indirect connection to ground. The contact elements each have forward ends at 104, 106 for connection to a pair of wires 130, 132 (FIG. 8) extending rearwardly from the interface coupling. The contact elements have rearward end portions 90, 140 (FIG. 2) with exposed rear ends 95, 82.

The grounded contact element 74 has a thread at 78 that lies in a mating threaded hole 80 in the rear end wall 84 of shell 32 to make direct contact with the grounded shell. Alternatively, a press fit can be used. A wire can be connected at the rear end 95 of the grounded contact to a location of ground potential, although the grounded contact is usually electrically grounded through the wire 130 which may connect a ground conductor which extends along the network along the cables 120, 122.

The nongrounded contact element 74 is isolated from the grounded metal shell 32 by a bushing part or bushing 92 which is an integral part of the dielectric container 46. The bushing extends forwardly from the rear end wall 50 of the container, through the larger nonground hole 93 in the shell. The nonground contact element has an accessible rear end 95 to which an external circuit (e.g. an amplifier) can be connected.

Figure 1:
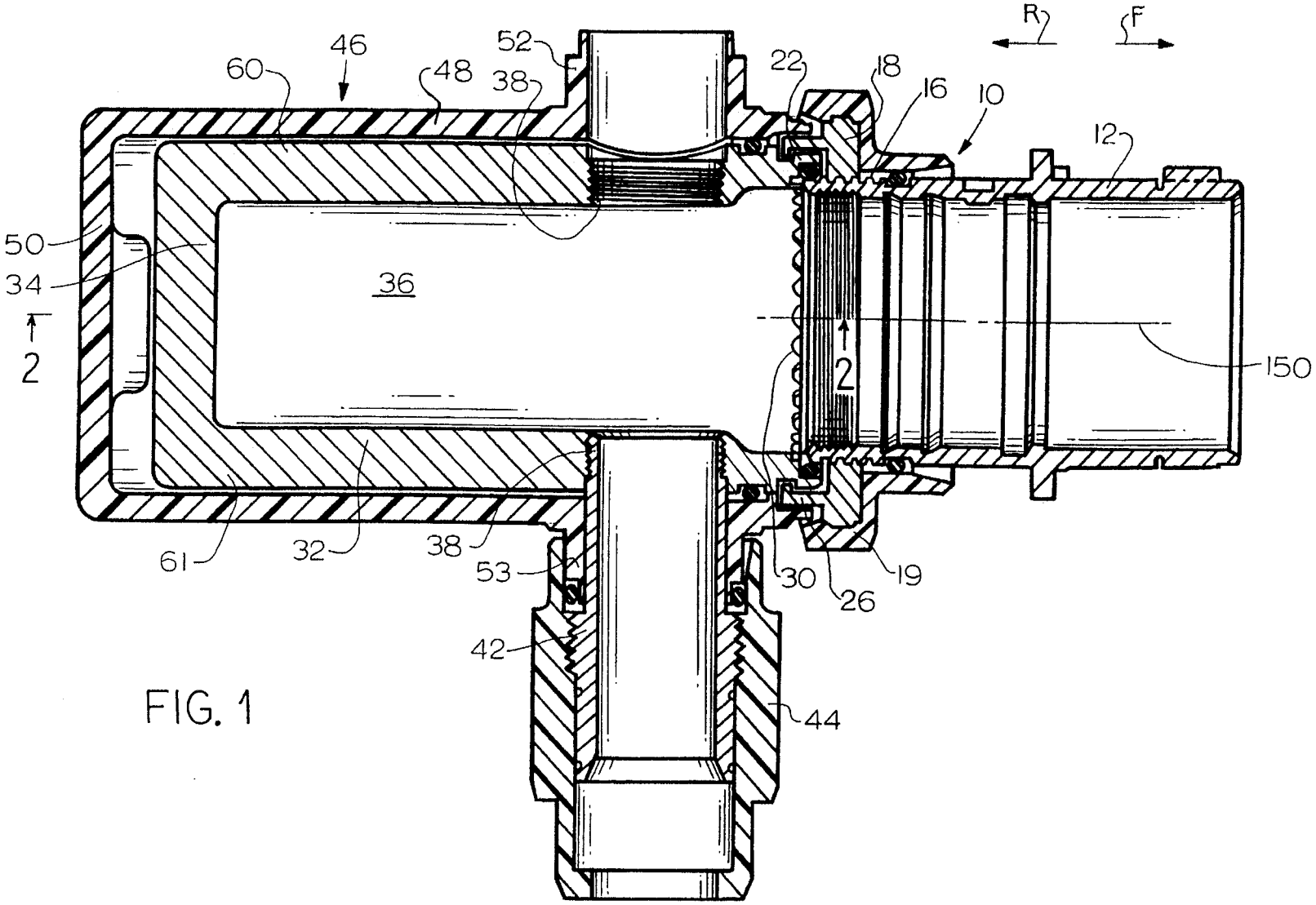
FIG. 1 is a partial sectional view side view of a connector constructed in accordance with the present invention, without the insert.

The dielectric container 46 (FIG. 1 and FIG. 8) is an integrally molded plastic member. The container has integrally molded top and bottom tube parts 52, 53 through which the wires or cables 120, 122 extend. A pair of grounded metal extenders such as extender 42 are usually provided to lie closely within the tube parts and surround the cables to provide EMI (electromagnetic interference) protection. Extender 42, has an end which is threadably mounted in a threaded hole 38 of the shell. The shell has thickened top and bottom portions 60, 61 where the threaded holes 38 are located. Where one of the tube parts is not used, as for a line termination, an extender such as 42 is not installed, and the tube part is blocked by a metal shielding disc indicated at 145, and an elastic cap 147.

The interface coupling 124 lies in a metal shell device or body 12 that has an external thread 16. The thread 16 screws into an assembly nut 18 that lies within a dielectric plug 19. The assembly nut 18 is freely rotatable within a groove 26 at the front 22 of the shell 32.

The front 22 of the shell 32 has axially-extending teeth 28 which engage corresponding axial teeth 30 at the rear end of the body 12. The teeth prevent relative rotation of the shell 32 and body 12. Tightening of the nut 18 assures good electrical contact between the shell 32 and the body 12.

The cables 120, 122 have metal braid shields 125, which are stripped away at the cable portions within the connector. The extender 42 is fitted with an insulating external sleeve 44 which allows the shielding braiding of the cables to be connected to the metal extender 42 and therefore to the metal body 12 via the shell 32. Usually, a fitting connects the braiding to the metal extender.

Figure 5:
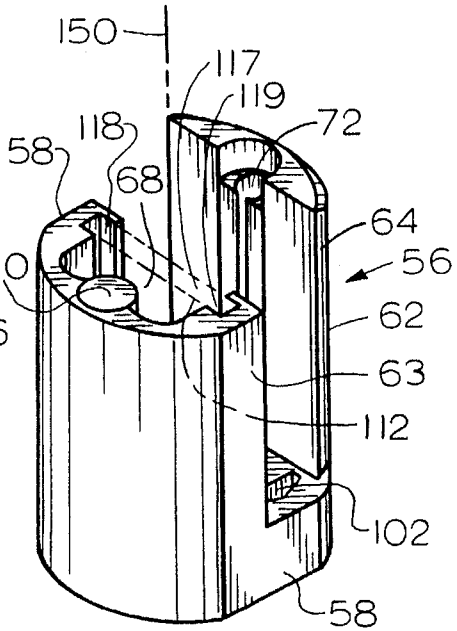
FIG. 5 is a rear isometric view of the insert of FIG. 4.
Figure 4:
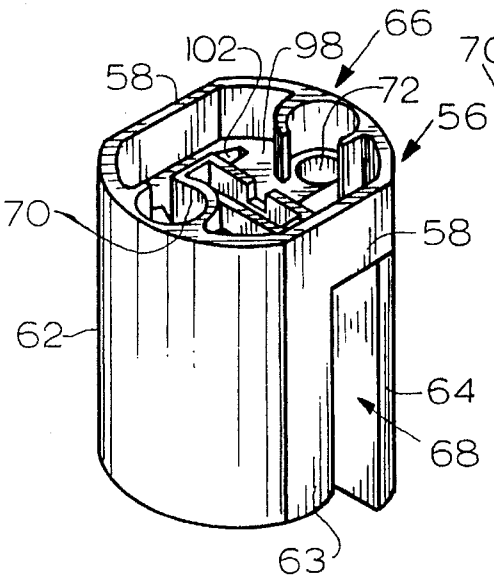
FIG. 4 is a front isometric view of the insert of FIG. 3.

As can be seen in FIGS. 4 and 5, the cartridge 56 has a dielectric frame 127 of general cylindrical shape but with two diametrically opposite flat outer surfaces 58 which lie against corresponding flat inner surfaces 60, 61 (FIG. 7) formed in the shell.

The cartridge frame 62 (FIGS. 4 and 5) has two main branches 63 and 64 which extend rearwardly from its front wall 98 and which delimit between them a component-holding region 68. Each of the two branches 63 and 64 forms a bore 70, 72 extending parallel to the housing and connector axis 150. Each electrical contact element 74, 76 (FIG. 2) lies in one of the bores 70, 72. The front end 86 of the contact element 74 has a threaded hole 88 intended to receive a fastening screw at a wire end. The front end 94 of the nonground contact element 76 has a similar threaded hole 96.

Figure 3:
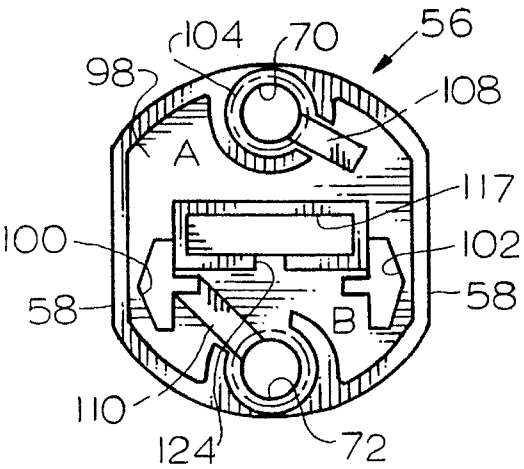
FIG. 3 is a view of the insert taken on line 3—3 of FIG. 2.

In cases where the cartridge 56 holds a capacitor C, the capacitor is received in the component-holding region 68 of the cartridge frame. The two leads 152, 154 of such capacitor extend through holes 100, 102 (FIG. 3) in the front wall 98 of the cartridge frame. The end of the capacitor leads have lugs 108, 110 that connect to the front ends of the contact elements at 104, 106 (FIG. 2).

Figure 6:
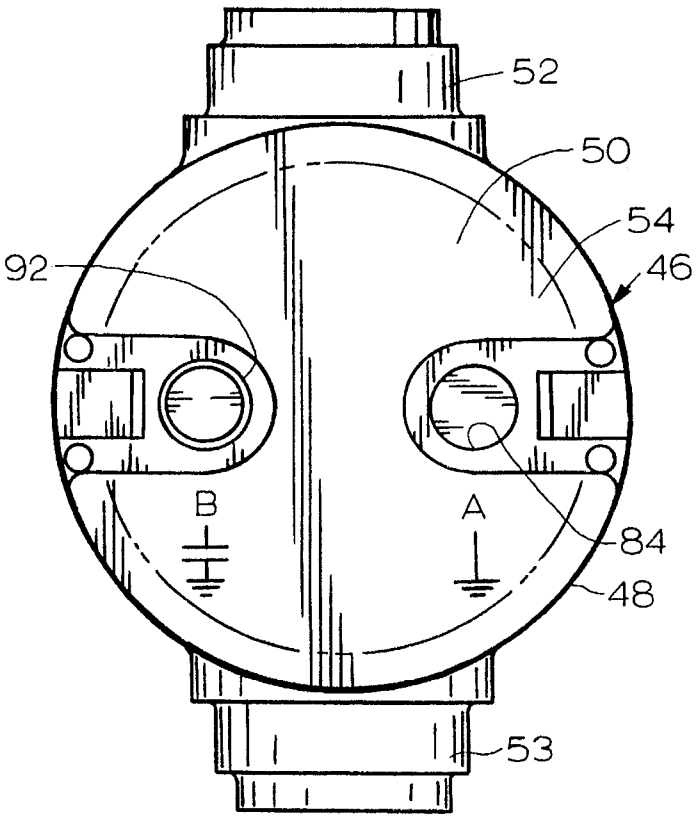
FIG. 6 is a rear elevation view of the connector of FIG. 1.

After connecting the body 12 and shell 32 and after having connected the electrical cables, the operator can choose the connection terminal which he desires to use. That is, he can choose either the direct grounded contact element 74 which is for example labelled by the letter A (FIG. 6) on the rear face 54 of the dielectric container 46, or the nonground contact element 76 which is connected through the capacitor and which is for example labelled by the letter B on the rear face 54.

When the operator desires to change the type of connection, it is sufficient for him to choose the other connection terminal without having to work inside the container. For example, the capacitor can be "short circuited" by a conductor extending between contact element ends 82, 95 (FIG. 2).

Where the connector element is an end element of a transmission line, the cartridge 56 receives an electronic line termination circuit. The electronic circuit lies on a circuit board which is shown in phantom lines at 112 in FIG. 5. The circuit board is of rectangular shape and has opposite edges received in two parallel slideways 118 and 119 formed in a guideway 117 in the cartridge frame 62. Wires for connection to the circuit 112 may pass through the front end wall 98 through holes 100, 102 in the front end wall 98. The cartridge 56 may hold both a line termination circuit 112 and a capacitor connected between the contact elements 74, 76.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A network connector comprising:

a dielectric container which has a dielectric rear end wall and a dielectric sleeve portion extending forwardly from said rear end wall, said dielectric rear end wall having ground and nonground holes, and having a dielectric bushing part aligned with said nonground hole and projecting forwardly from said rear end wall;

a metal shell having a shell rear wall lying slightly forward of said container rear end wall, said shell having a shell sleeve portion lying closely within said dielectric sleeve portion, said shell rear wall having ground and nonground holes aligned respectively with said ground and nonground holes of said dielectric rear end wall, and said dielectric bushing projecting forwardly into said nonground hole;

a cartridge lying within said metal shell, said cartridge having a dielectric cartridge housing with a component-holding region therein and with ground and nonground contact elements, said ground contact element having a rear portion engaged with walls of said ground hole of said shell rear wall, and said nonground contact extending rearward through said bushing part and through said nonground hole in said shell rear wall and having a rear end that is exposed from a rear surface of said dielectric rear end wall.

2. The connector described in claim 1 wherein:

said metal shell has top and bottom threaded openings in said shell sleeve portion, at locations lying forward of said cartridge;

said dielectric container is of molded plastic, and includes top and bottom openings in said dielectric sleeve portion which are aligned with said top and bottom threaded openings of said shell, with said dielectric container having top and bottom tube part integral with said dielectric sleeve portion, said tube parts being aligned with said top and bottom openings in said metal shell and projecting respectively upwardly and downwardly from said dielectric sleeve portion;

top and bottom metal extensions, each projecting through one of said tube parts and threadably connected at a corresponding one of said shell threaded openings.

3. The connector described in claim 1 wherein:

said dielectric container is of molded plastic, and includes top and bottom openings in said dielectric sleeve portion;

said metal shell has top and bottom threaded openings in said shell sleeve portion, at locations lying forward of said cartridge and aligned with said top and bottom openings in said dielectric container;

said shell has an inside with opposite sides which are each a section of a cylinder, and top and bottom parts which are flat and which leave thickened shell regions, with said threaded openings extending through said thickened shell regions;

said cartridge having an external surface that substantially matches said shell inside.

4. A network connector comprising:

a dielectric container which has a dielectric rear end wall and a dielectric sleeve portion extending forwardly from said rear end wall;

a metal shell having a shell rear wall lying slightly forward of said container rear end wall and having a shell sleeve portion lying closely within said dielectric sleeve portion;

a cartridge lying within said metal shell, said cartridge having a dielectric cartridge housing with a component-holding region therein, said cartridge housing having a front wall with a pair of element-receiving holes and a pair of lead-receiving holes, and said cartridge including a pair of contact elements with front ends lying in said element-receiving holes and having threaded holes in said front ends;

a circuit component having a component body lying in said component-holding region and having a pair of leads each extending forwardly through said lead-receiving holes in said cartridge front wall and connected to said front ends of said contact elements.

5. The network connector described in claim 4 wherein:

said container has a front end, and including a body attached to said container front end;

an interface coupling mounted in said body, said interface coupling having a coupling rear end and having a plurality of wires extending from coupling rear end with each wire connected to one of said contact element front ends.

6. The network connector described in claim 4 wherein:

said metal shell rear wall has ground and nonground holes;

said container rear end wall has a dielectric bushing part that is integral with the rest of said container rear end wall and that projects forwardly through said nonground hole in said bushing;

said pair of contact elements include ground and nonground elements, with said ground element having a rear portion engaged with walls of said shell ground hole and with said nonground element having a rear portion passing through said bushing and said shell nonground hole, and with each of said contact elements having a rear end that is accessible from a location rearward of said container rear wall.

7. The connector described in claim 4 wherein:

said metal shell sleeve portion has top and bottom threaded openings, at locations lying forward of said cartridge;

said dielectric container is of molded plastic, and includes top and bottom openings in said dielectric sleeve portion which are aligned with said top and bottom threaded openings of said shell sleeve portion, with said dielectric container having top and bottom tube part integral with said dielectric sleeve portion, said tube parts being aligned with said top and bottom openings in said metal shell, and projecting respectively upwardly and downwardly from said dielectric sleeve portion; and including a metal extension projecting through one of said tube parts and threadably connected at a corresponding one of said shell threaded openings.

8. The connector described in claim 4 wherein:

said dielectric container is of molded plastic, and includes top and bottom openings in said dielectric sleeve portion;

said metal shell has top and bottom threaded openings in said shell sleeve portion, at locations lying forward of said cartridge and aligned with said top and bottom openings in said dielectric container;

said shell has an inside with opposite sides which are each a section of a cylinder, and top and bottom parts which are flat and which leave thickened shell regions, with said threaded openings extending through said thickened shell regions;

said cartridge having an external surface that substantially matches said shell inside.

* * * * *